US011134795B2

(12) United States Patent
Papera

(10) Patent No.: US 11,134,795 B2
(45) Date of Patent: Oct. 5, 2021

(54) INFANT SAFETY BARRIER

(71) Applicant: DuckUp LLC, Hoboken, NJ (US)

(72) Inventor: Steven Papera, Hoboken, NJ (US)

(73) Assignee: DuckUp LLC, Hoboken, NJ (US)

( * ) Notice: Subject to any disclaimer, the term of this patent is extended or adjusted under 35 U.S.C. 154(b) by 0 days.

(21) Appl. No.: 16/598,815

(22) Filed: Oct. 10, 2019

(65) Prior Publication Data

US 2021/0106146 A1 Apr. 15, 2021

(51) Int. Cl.
*E06B 3/68* (2006.01)
*A47D 15/00* (2006.01)

(52) U.S. Cl.
CPC ..... *A47D 15/005* (2013.01)

(58) Field of Classification Search
CPC ..... E06B 9/02; E06B 2009/002; E06B 2009/801; E06B 9/80; E06B 9/06; E06B 9/0692; E06B 9/08; E04F 11/1861; E04F 11/1855; E04F 11/1857; E01F 13/028
USPC ..... 49/50, 54, 57; 160/368.1, 370, 351; 242/385.4; 256/73, 24
See application file for complete search history.

(56) References Cited

U.S. PATENT DOCUMENTS 3,180,984 A 4/1965 Fertig et al.
3,279,549 A 10/1966 Feinberg et al.
5,460,353 A * 10/1995 Rittenhouse ..... A63B 71/028 160/135
5,613,543 A * 3/1997 Walton ..... E04G 5/12 135/119
6,375,165 B1 * 4/2002 Sherratt ..... E06B 9/0692 256/1
7,438,112 B2 * 10/2008 Cheng ..... E01F 13/028 160/24
10,081,980 B2 * 9/2018 Birkert ..... E06B 9/04
10,538,958 B2 * 1/2020 Losik ..... E06B 9/01
10,794,022 B2 * 10/2020 Reiner ..... B65H 75/48
2008/0121352 A1 * 5/2008 Cheng ..... E06B 9/08 160/238

(Continued)

FOREIGN PATENT DOCUMENTS

FR 2772577 A1 6/1999
FR 2803732 A1 7/2001

(Continued)

*Primary Examiner* — Chi Q Nguyen
(74) *Attorney, Agent, or Firm* — Budzyn IP Law, LLC

(57) ABSTRACT

In accordance with the subject invention, an infant safety barrier is provided which includes: a first mounting body; a second mounting body; a first stanchion pivotably mounted to the first mounting body so as to be reversibly pivotable between upright and non-upright positions; a second stanchion pivotably mounted to the second mounting body so as to be reversibly pivotable between upright and non-upright positions; and, an elongated flexible barrier a first end secured to the first stanchion and a second end secured to the second stanchion, wherein, with the first and second stanchions being in the upright positions, the flexible barrier is relatively taut between the first and second stanchions. Advantageously, with the subject invention, an infant safety barrier is provided which can be reversibly adjusted between an upright safety position, to restrict an infant's fall from an elevated location, and a non-upright position, allowing access to the infant.

14 Claims, 7 Drawing Sheets

(56) References Cited

U.S. PATENT DOCUMENTS

| | | | | |
|---|---|---|---|---|
| 2009/0172880 | A1* | 7/2009 | Wu | A47C 21/08 5/425 |
| 2012/0256149 | A1* | 10/2012 | Sylvester | E01F 13/028 256/73 |
| 2018/0044868 | A1* | 2/2018 | Miller | E04H 17/00 |
| 2018/0078052 | A1* | 3/2018 | Levine | A47D 15/008 |
| 2019/0063018 | A1* | 2/2019 | Reiner | B65H 75/4471 |

FOREIGN PATENT DOCUMENTS

| | | | |
|---|---|---|---|
| JP | 3111882 | U | 7/2005 |
| WO | 2019016037 | A1 | 1/2019 |

* cited by examiner

INFANT SAFETY BARRIER

FIELD OF THE INVENTION

The subject invention relates to infant safety devices, and, more particularly, to furniture-related infant safety devices.

BACKGROUND OF THE INVENTION

Infant safety devices are well known in the prior art. Many devices have been developed for limiting the ability of an infant to fall from a piece of furniture or other elevated position. For example, U.S. Pat. No. 3,279,549 discloses an extendible mesh barrier for positioning around a baby scale to limit the risk of an infant falling off the scale. Japanese Utility Model No. 3111882 U discloses upright mesh nets positioned along longitudinal edges of a bed to limit the risk of a person falling out of the bed.

Certain baby furniture, such as diaper changing tables, require continuous access to a work area. With such furniture, risk may be present with leaving an infant unattended while resting on such furniture. Devices have been developed in the prior art which provide a level of safety for an infant resting on a diaper change table, with such devices also permitting access to allow for the changing of a diaper. For example, WO 2019/016037 discloses a pivotable barrier which has a normally upright position and can be lowered by a user stepping on a pedal or pressing against a button control. Similarly, French Patent No. 2 803 732 discloses pivotable upright barriers configured to be pivoted to a downward position by a user. French Patent No. 2 772 577 discloses a perimetrical mesh barrier which is downwardly collapsible.

U.S. Pat. No. 3,180,984 discloses a spring-biased mesh safety net strung across a horizontal frame to act as a safety shelf for an infant resting on a diaper changing table. The safety shelf is biased to a normally outward position, but can be pressed into the table by a user to allow for closer access to the infant. Counterweights are required along the edge of the table opposite the shelf to ensure proper counterbalancing to offset against an infant actually rolling onto the safety shelf.

SUMMARY OF THE INVENTION

In accordance with the subject invention, an infant safety barrier is provided which includes: a first mounting body; a second mounting body; a first stanchion pivotably mounted to the first mounting body so as to be reversibly pivotable between an upright position and a non-upright position; a second stanchion pivotably mounted to the second mounting body so as to be reversibly pivotable between an upright position and a non-upright position; and, an elongated flexible barrier having spaced apart first and second ends, the first end being secured to the first stanchion, and the second end being secured to the second stanchion, wherein, with the first and second stanchions being in the upright positions, the flexible barrier is relatively taut between the first and second stanchions. Advantageously, with the subject invention, an infant safety barrier is provided which can be reversibly adjusted between an upright safety position, to restrict an infant's fall from an elevated location, and a non-upright position, allowing access to the infant.

These and other features of the invention will be better understood through a study of the following detailed description and accompanying drawings.

DETAILED DESCRIPTION OF THE INVENTION

Figure 1:
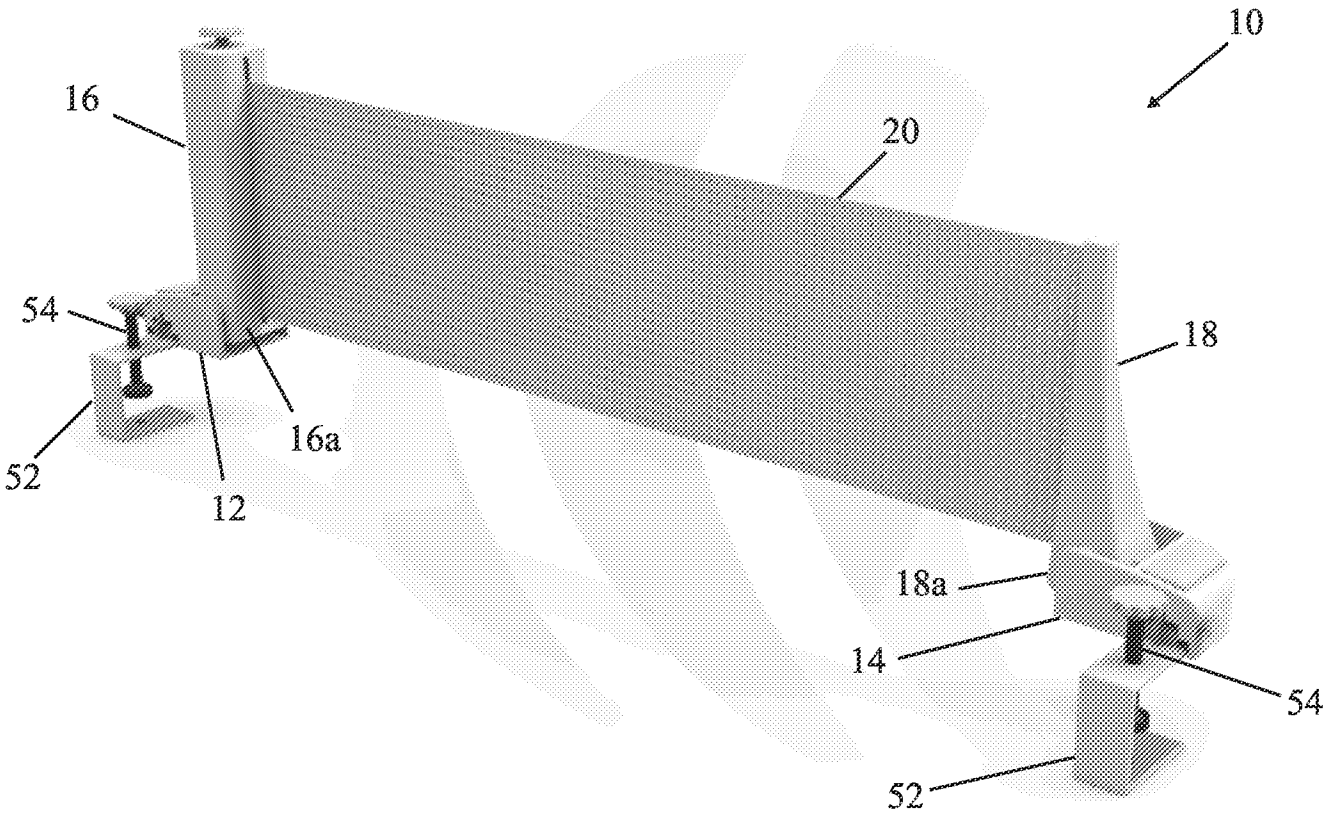
FIG. 1 is perspective view of an infant safety barrier formed in accordance with the subject invention.
Figure 2:
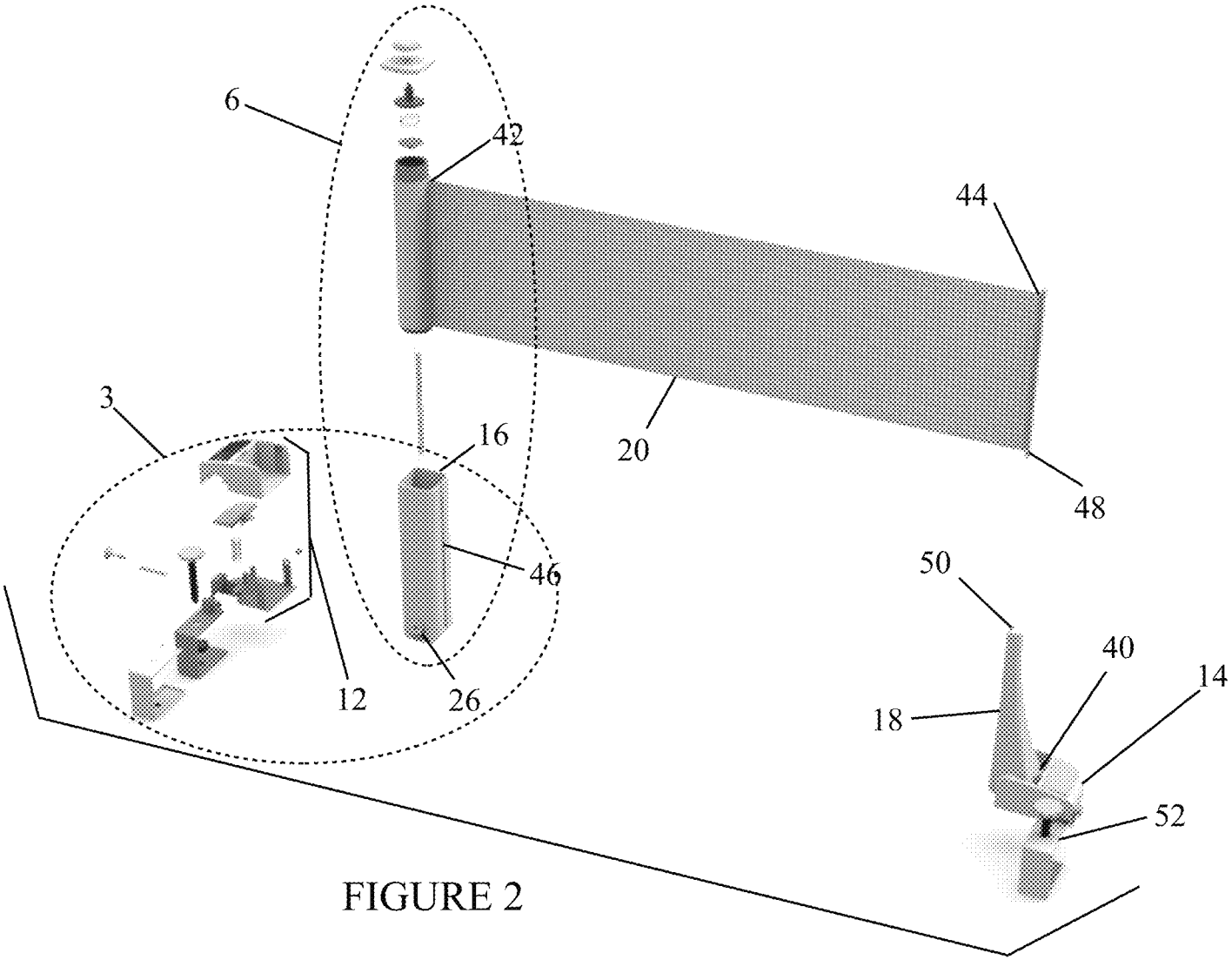
FIG. 2 is an exploded view of the infant safety barrier of FIG. 1.

With reference to FIG. 1, an infant safety barrier 10 is provided generally including a first mounting body 12, a second mounting body 14, a first stanchion 16, a second stanchion 18, and a flexible barrier 20. The infant safety barrier 10 is well-suited for mounting to furniture, e.g., a diaper changing table, or an elevated surface, e.g., a tabletop where an infant is resting.

Figure 3:
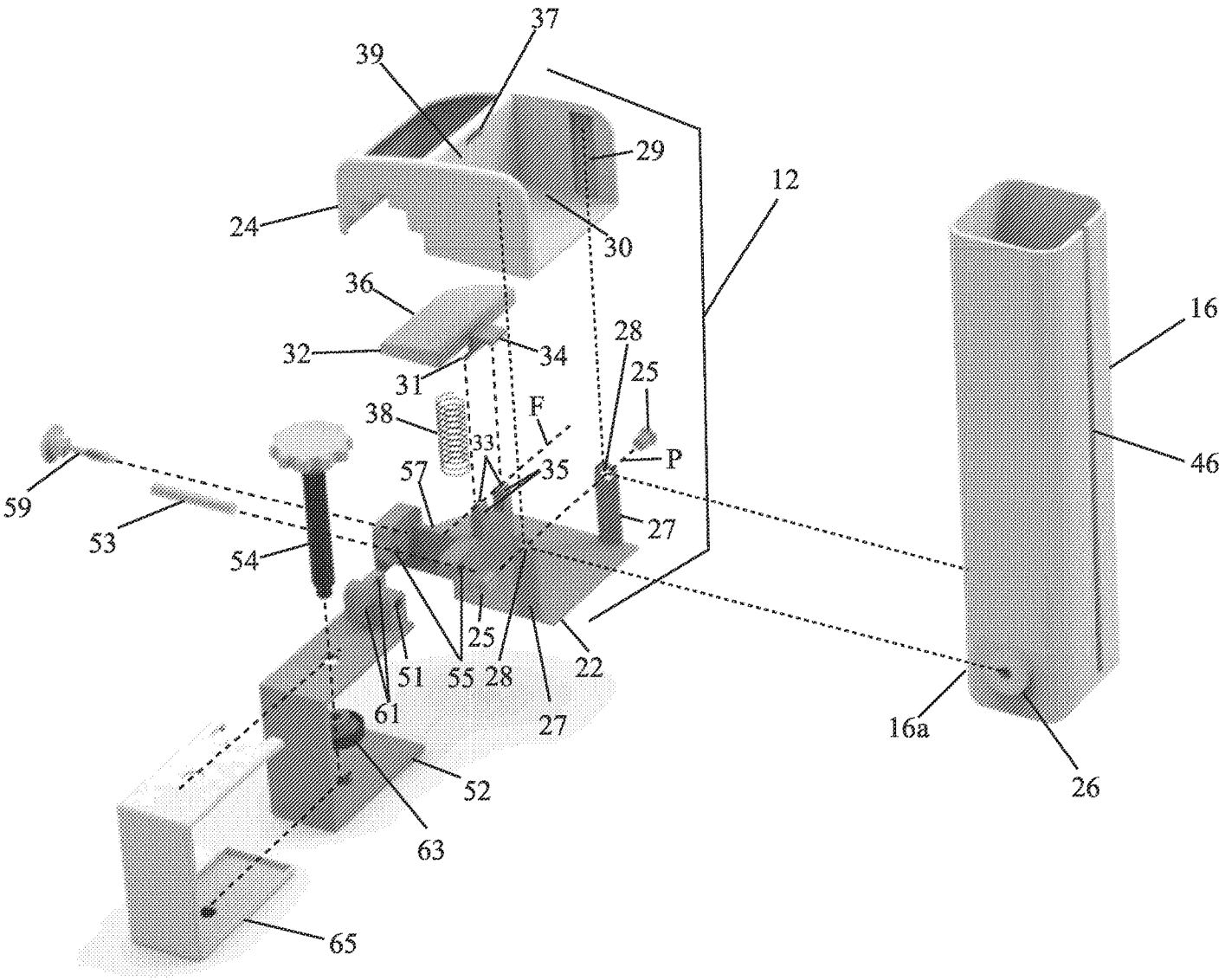
FIG. 3 is an enlarged view of Section 3 of FIG. 2.

The first and second mounting bodies 12, 14 may be similarly formed, but oriented in opposing directions to provide a left mounting body (e.g., the first mounting body 12) and a right mounting body (e.g., the second mounting body 14). FIG. 3 shows the first mounting body 12 in an exploded manner, the second mounting body 14 having a similar construction. As can be seen, each of the first and second mounting bodies 12, 14 includes a base 22 and a housing 24. The base 22 may be metallic and the housing 24 may be polymeric (e.g., formed of one or more thermoplastics).

Figure 4:
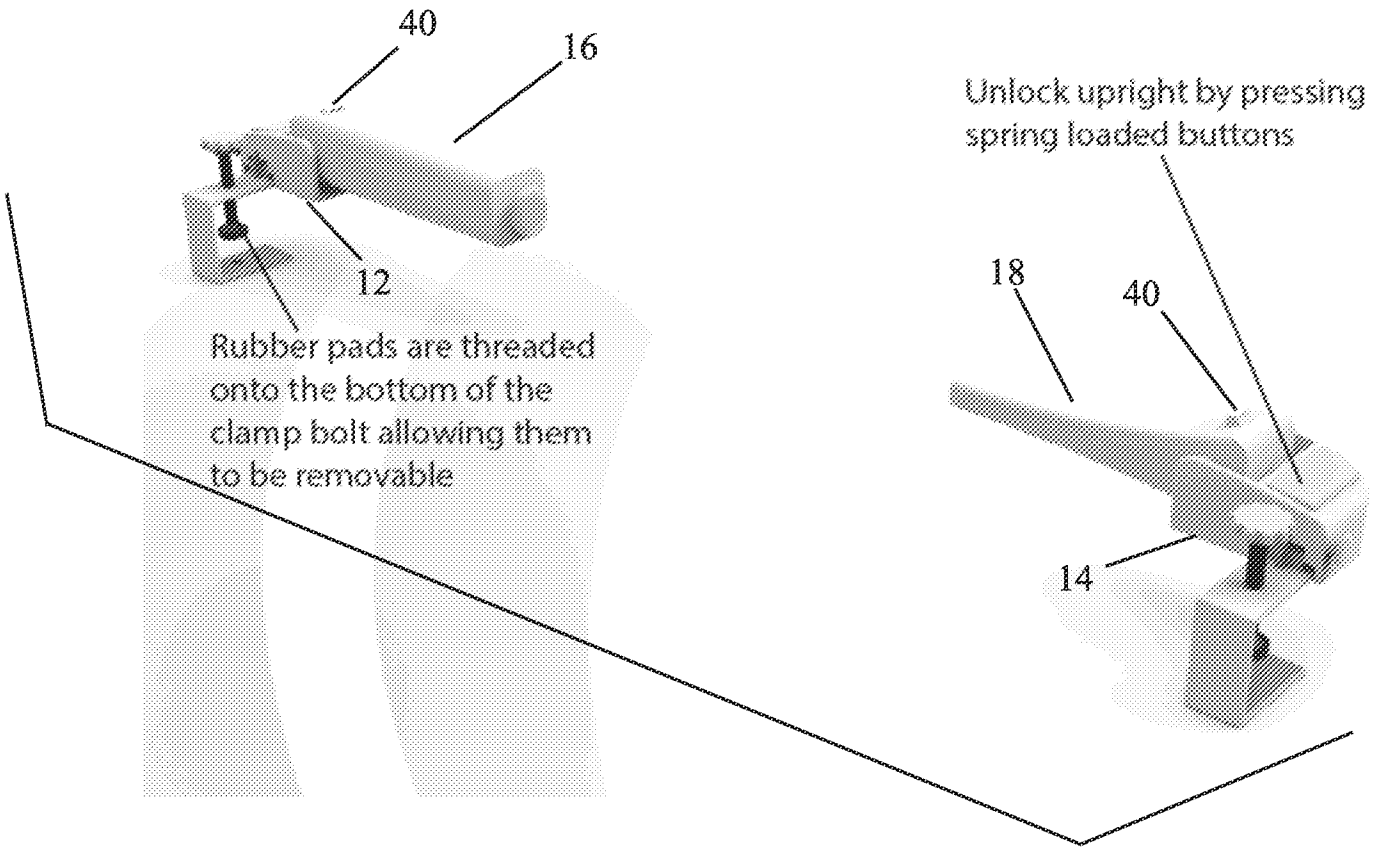
FIG. 4 is a perspective view of the infant safety barrier showing the stanchions in down positions.

The first and second stanchions 16, 18 are pivotably mounted to the first and second mounting bodies 12, 14, respectively, in any known manner. By way of non-limiting example, the first and second stanchions 16, 18 may be each provided with a pair of trunnions 26 aligned to define a pivot axis P. The first and second mounting bodies 12, 14 may be each provided with pivot holes 28 positioned to be aligned along the pivot axis P and configured to receive the trunnions 26 therein. Fasteners 25, such as screws, pins, rivets, and so forth, may be provided to fix the trunnions 26 to the pivot holes 28, still allowing for pivoting movement therebetween. The pivot holes 28 may be formed in the base 22 and/or the housing 24 configured to allow the first and second stanchions 16, 18 to pivot relative to the first and second mounting bodies 12, 14, respectively, between upright and non-upright positions. For example, the pivot holes 28 may be defined in upstanding arms 27 provided on the base 22, which may be slid into receiving slots 29 formed in the housing 24. As shown in FIG. 4, the first and second mounting bodies 12, 14 are arranged to have the first and second stanchions 16, 18 be downwardly pivotable in directions towards one another (i.e., the first and second stanchions 16, 18 are inwardly pivotable toward one another). In an alternative arrangement, as will be appreciated by those skilled in the art, the pivot arrangement may be reversed in full, or partly, with at least one of the trunnions 26 being provided on the first and/or second mounting bodies 12, 14 and at least one of the pivot holes 28 being provided on the first and/or second stanchions 16, 18.

The housing 24 of each of the first and second mounting bodies 12, 14 may define a compartment 30 for receiving a lower portion 16*a*, 18*a* of the respective first and second stanchion 16, 18. The pivot holes 28 may be positioned along the compartment 30, e.g., with the upstanding arms 27 received in the receiving slots 29.

It is preferred that the first and second mounting bodies 12, 14 be provided with releasable retaining arrangements to resist downward pivoting (particularly unwanted downward pivoting) of the first and second stanchions 16, 18 whilst in the upright positions. By way of non-limiting example, each of the first and second mounting bodies 12, 14 may be provided with a button 32 pivotably mounted to the base 22 and/or the housing 24, e.g., with receipt of axle 31 in notches 33 of pivot arms 35. The button 32 includes a tab 34 positioned to extend into the compartment 30, e.g., through slot 37 formed in bulkhead 39. The button 32 is mounted to pivot about a fulcrum F located between the tab 34 and a rear edge 36 spaced from the tab 34. A spring 38, or other biasing mechanism, is positioned between the base 22 and the button 32 to apply a pressing force against the button 32 between the fulcrum F and the rear edge 36. In this manner, the tab 34 is urged downwardly. Further, each of the first and second stanchions 16, 18 is provided with a protruding locking detent 40 positioned to by-pass the corresponding tab 34 with pivoting of the respective first or second stanchion 16, 18. With the first or second stanchion 16, 18 being pivoted to an upright position, the locking detent 40 is caused to come into contact with the respective tab 34. The button 32 is resiliently deflectable in response to the contact with the locking detent 40 allowing the locking detent 40 to by-pass the respective tab 34 with further pivoting movement. With the locking detent 40 having fully by-passed the respective tab 34, the respective tab 34, under force of the spring 38, is urged to its normal rest position in alignment with the pivoting track of the locking detent 40. As such, the tabs 34 resist reverse pivoting movement of the locking detents 40, thus, resisting pivoting of the first and second stanchions 16, 18 into non-upright positions.

The rear edges 36 of the buttons 32 may be each downwardly deflectable, resulting in upward movement of the respective tabs 34, thus, clearing the pivoting track of the locking detents 40 and allowing pivoting of the first and second stanchions 16, 18 to non-upright positions. Upon release, the springs 38 may return the buttons 32 to normal, rest positions.

Figure 5:
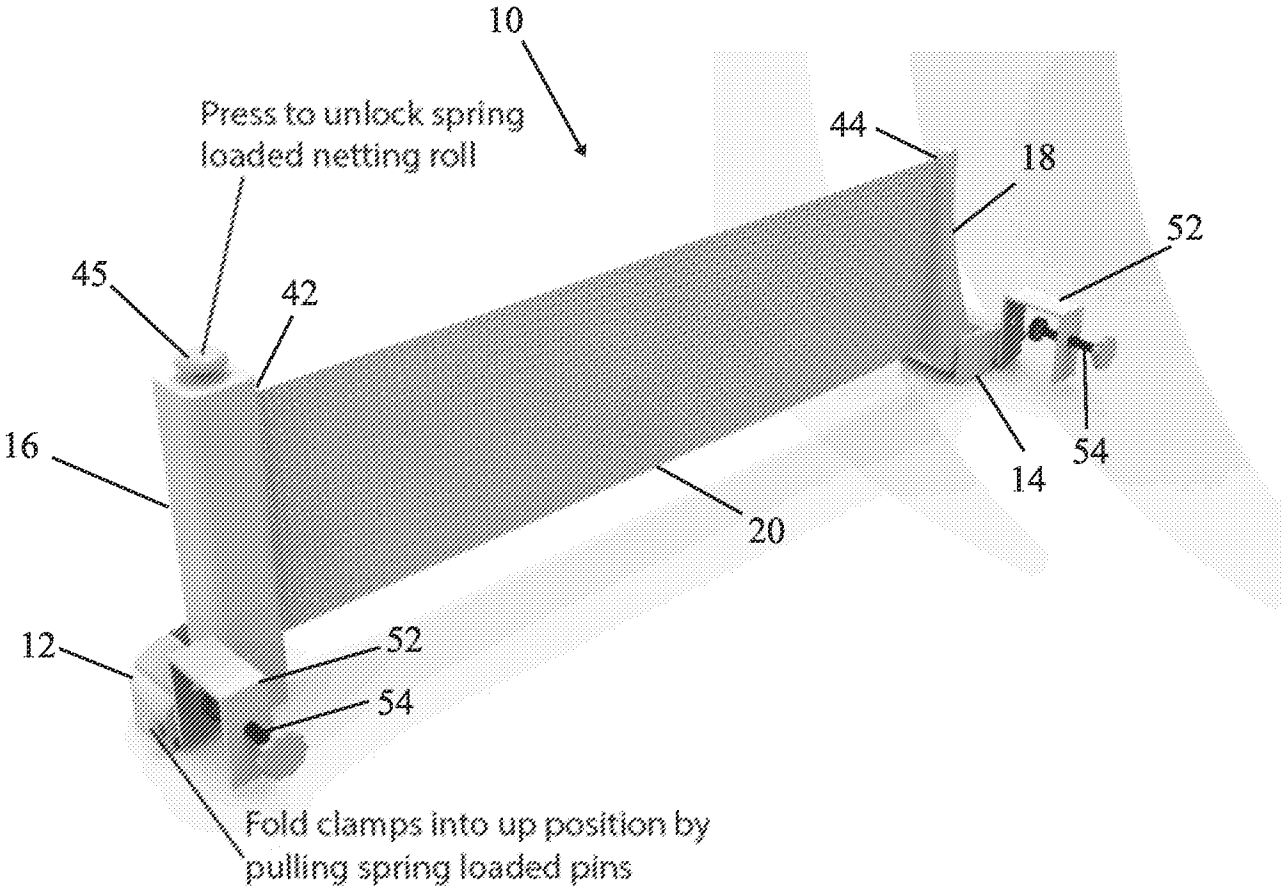
FIG. 5 is a perspective view of the infant safety barrier in a safety state.
Figure 7:
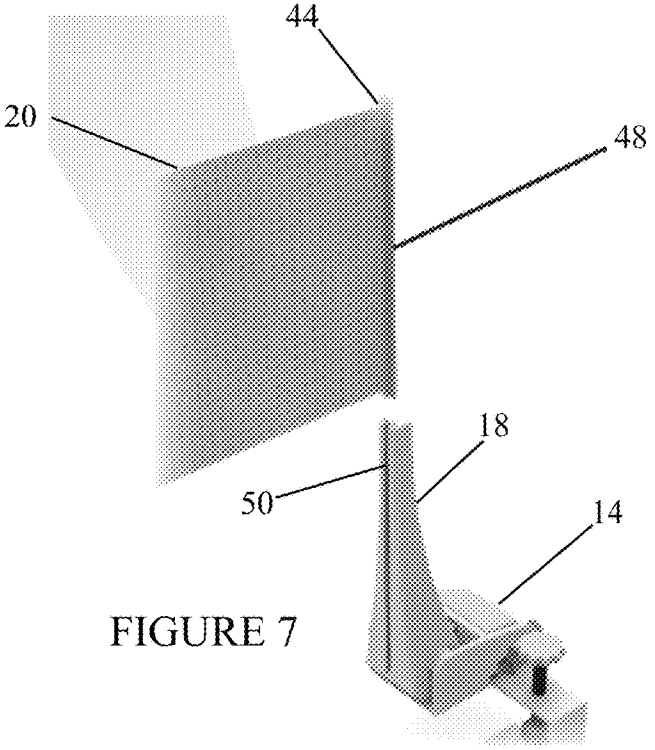
FIG. 7 shows the flexible barrier being received by the second stanchion.
Figure 6:
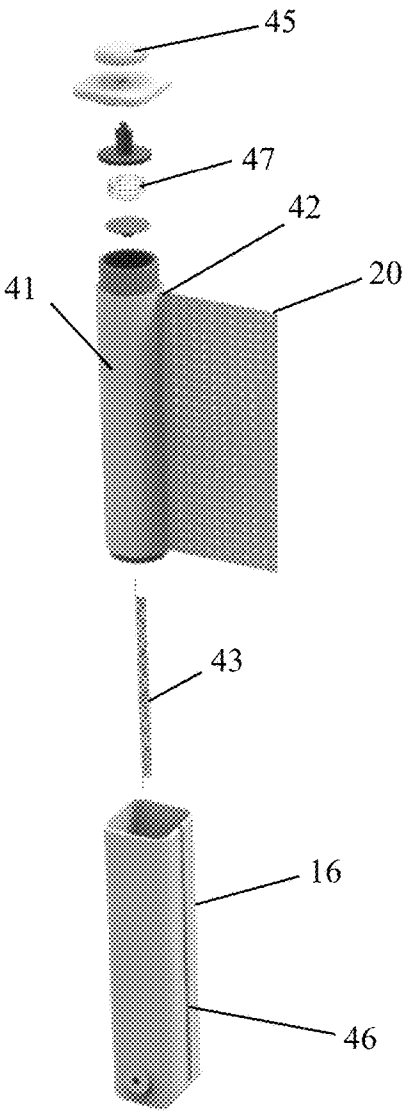
FIG. 6 is an enlarged view of Section 6 of FIG. 2.

The flexible barrier 20 is preferably a flexible polymeric sheet (which may be perforated), a collapsible textile, and/or a mesh structure, elongated with first and second ends 42, 44. The flexible barrier 20 preferably has minimal elasticity, so that when taut, the flexible barrier 20 is minimally extensible. The first end 42 is secured to the first stanchion 16, and the second end 44 is secured to the second stanchion 18. The first and second stanchions 16, 18 are sufficiently spaced apart so that the flexible barrier 20 may be relatively taut with the first and second stanchions 16, 18 being in upright positions to provide a safety state of the infant safety barrier 10, as shown in FIG. 5. The infant safety barrier 10, in the safety state, is located to be along the infant to act as a restraint against the infant falling from an elevated position. This allows a caretaker to allow the infant to rest on a surface, such as a change surface on a diaper changing table, while the caretaker is preoccupied with other tasks. Once ready, the first and second stanchions 16, 18 may be pivoted to non-upright positions, thus, causing the flexible barrier 20 to slacken and be lowered. This allows for unencumbered access to the infant.

The flexible barrier 20 may be permanently secured to the first and second stanchions 16, 18. In the alternative, the flexible barrier 20 may be retractable into the body of one of the stanchions, such as the first stanchion 16, for storage therein. Any retracting arrangement may be utilized. For example, a slit 46 may be formed through the first stanchion 16 through which the flexible barrier 20 may be extended and retracted. To prevent full retraction of the flexible barrier 20 into the first stanchion 16, a mounting rib 48 is provided along the second end 44 having a width greater than the slit 46 to resist passing therethrough. The first end 42 may be secured to collection tube 41 formed to be received within the first stanchion 16. Radial spring 43, or other radial biasing means, may be situated to rotate the collection tube 41, thus providing an inwardly directed pulling force on the flexible barrier 20 which provides tension thereto. The second stanchion 18 may have a secondary slit 50, also narrower than the mounting rib 48. It is preferred that the secondary slit 50 be open on top to allow the mounting rib 48 to be inserted thereinto with the flexible barrier 20 extending through the secondary slit 50. Tension may be applied to the flexible barrier 20 by the retracting arrangement with the mounting rib 48 retaining the flexible barrier 20 secured to the second stanchion 18.

To prevent unwanted extension of the flexible barrier 20 from a storage position within the first stanchion 16, a release button 45 may be provided configured to be urged to an up position by spring 47. Depression of the button 45, against force of the spring 47, releases the flexible barrier 20 from a locked state, e.g., releasing the collection tube 41 from a locked state, thereby allowing the flexible barrier 20 to be extended from the from first stanchion. Once extended, release of the flexible barrier 20 may result in automatic retraction into the first stanchion 16 for storage, with automatic setting of the locked state. Alternatively, with the flexible barrier 20 fixed to the second stanchion 18, the flexible barrier 20 may be tensioned by depression of the button 45, against force of the spring 47, to release the flexible barrier 20 from a locked state, which allows for retraction to pull the flexible barrier 20 taut. Removal of pressing force from the button 45, allows the button 45 to return to its up position, thus, causing the flexible barrier 20 to return to the locked state.

The infant safety barrier 10 may be mounted in any manner to provide safety for an infant. The infant safety barrier 10 may be built into a piece of furniture, with the bases 22 of the first and second mounting bodies 12, 14 being rigidly fixed to a surface of the furniture. Alternatively, a mounting arrangement many be provided for the first and second mounting bodies 12, 14 to allow the infant safety barrier 10 to be an add-on to an existing piece of furniture and/or for temporary surface mounting as needed. By way of non-limiting example, a C-shaped bracket 52 may be provided for each of the first and second mounting bodies 12, 14, mountable to the respective base 22 with an adjustable locking screw 54. The bracket 52 may be slipped over an edge of a mounting surface with the locking screw 54 being tightened to fix the bracket 52 in place.

As shown in FIG. 3, the brackets 52 may be horizontally aligned to lock to an horizontal edge or other horizontal structure. The brackets 52 may be pivotably mounted to the first and second mounting bodies 12, 14, to allow for adjustment between horizontal and vertical alignments. For example, the bracket 52 may each include a pivot aperture 51 formed to receive pin 53 which is secured to openings 55 in yoke 57 formed on the base 22. With this arrangement, the brackets 52 may pivot between horizontal (FIG. 1) and vertical (FIG. 5) alignments. A spring-biased locking pin 59 may be provided to seat in one of the locking apertures 61, formed on the bracket 52, to secure the bracket 52 in a vertical or horizontal alignment.

A rubber cushion 63 may be provided with each of the locking screws 54 positioned to interface with a support surface. The rubber cushion 63 may act as a protective cushion against the support surface and provide an enhanced frictional engagement with the support surface. In addition, a capping structure 63 may be provided for each of the brackets 52 to provide a more finished appearance.

Figure 8:
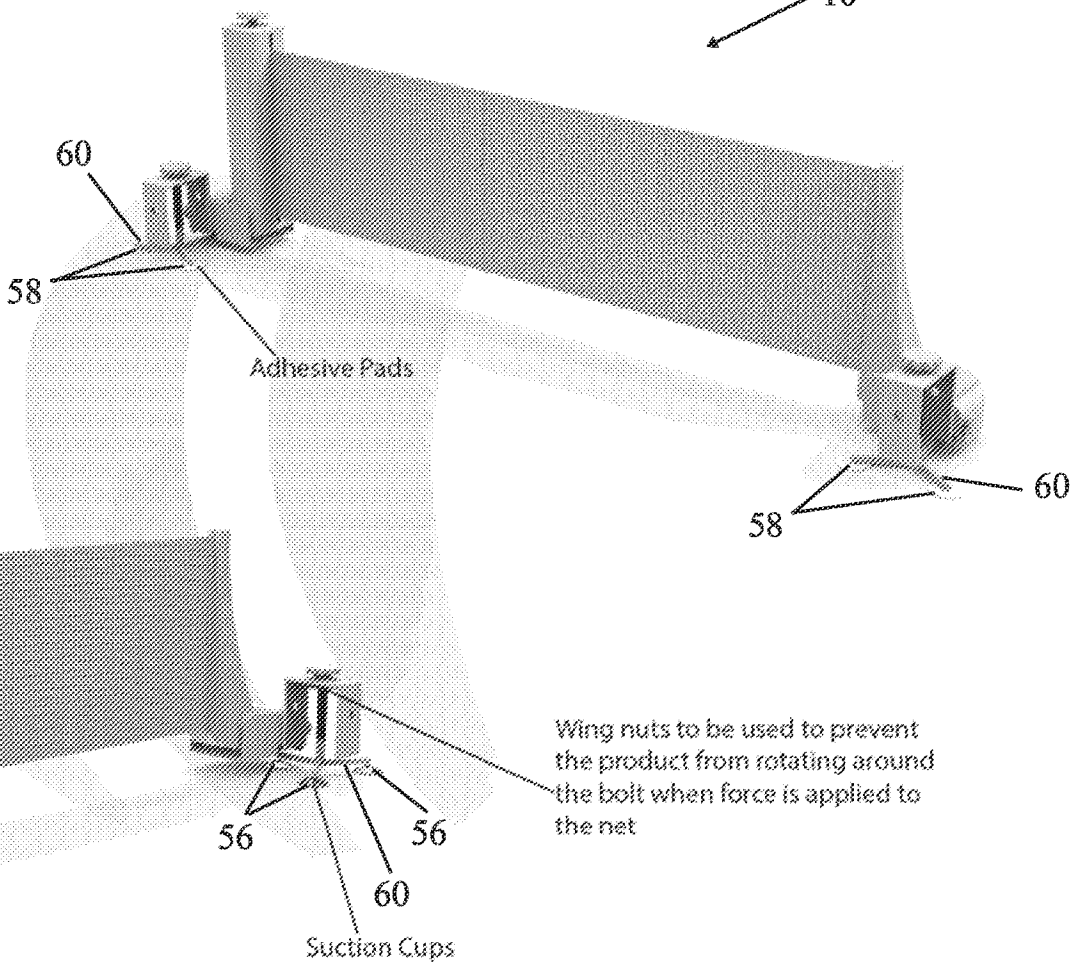
FIGS. 8-9 show alternative modes of securement for the infant safety barrier; and, FIGS. 10-12 show an exemplary infant safety barrier.
Figure 9:
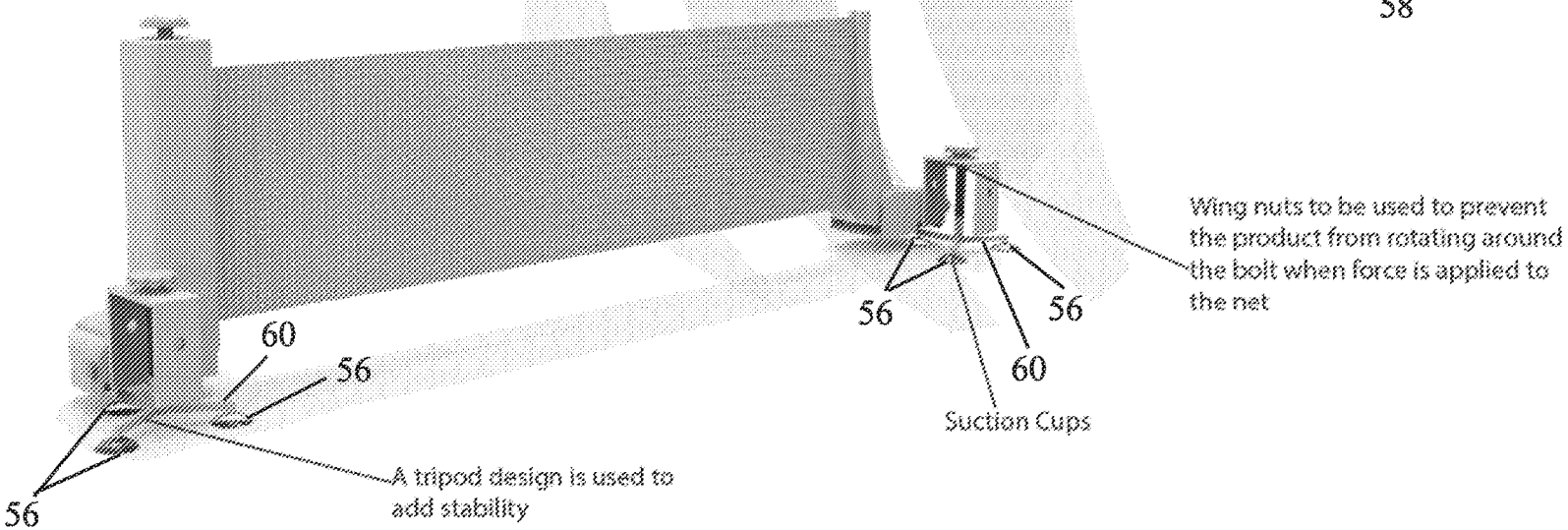

As a further alternative, as shown in FIGS. 8 and 9, one or more suction cups 56 and/or adhesive pads 58 may be provided on the locking screws 54 for adherence to a rigid surface. The suction cups 56 and/or the adhesive pads 58 may be provided on multi-leg supports, such as tripod structures 60.

FIGS. 10-12 include dimensions of an exemplary infant safety barrier 10.

What is claimed is:

1. An infant safety barrier comprising:

a first mounting body;

a second mounting body;

a first stanchion pivotably mounted to the first mounting body so as to be reversibly pivotable, about a first pivot axis, between a first upright position and a first non-upright position, wherein the first stanchion is elongated to extend along a first longitudinal axis, the first pivot axis being transverse to the first longitudinal axis;

a second stanchion pivotably mounted to the second mounting body so as to be reversibly pivotable, about a second pivot axis, between a second upright position and a second non-upright position, wherein the second stanchion is elongated to extend along a second longitudinal axis, the second pivot axis being transverse to the second longitudinal axis; and, an elongated flexible barrier having spaced apart first and second ends, the first end being secured to the first stanchion, and the second end being secured to the second stanchion, wherein, with the first and second stanchions being in the respective first and second upright positions, the flexible barrier is relatively taut between the first and second stanchions.

2. The infant safety barrier as in claim 1, wherein the first mounting body includes a first means for mounting to a surface.

3. The infant safety barrier as in claim 1, wherein the second mounting body includes a second means for mounting to a surface.

4. The infant safety barrier as in claim 1, wherein the flexible barrier includes a textile.

5. The infant safety barrier as in claim 1, wherein the flexible barrier includes a mesh structure.

6. The infant safety barrier as in claim 1, wherein the flexible barrier includes a polymeric sheet.

7. The infant safety barrier as in claim 1, wherein the first stanchion pivots from the first upright position to the first non-upright position in a direction towards the second stanchion.

8. The infant safety barrier as in claim 7, wherein the second stanchion pivots from the second upright position to the second non-upright position in a direction towards the first stanchion.

9. The infant safety barrier as in claim 1, wherein the first mounting body includes a releasable retaining arrangement for resisting pivoting of the first stanchion from the first upright position to the first non-upright position.

10. The infant safety barrier as in claim 9, wherein the second mounting body includes a releasable retaining arrangement for resisting pivoting of the second stanchion from the second upright position to the second non-upright position.

11. The infant safety barrier as in claim 1, wherein the flexible barrier is storable inside the first stanchion.

12. The infant safety barrier as in claim 11, wherein a first slit is formed in the first stanchion with the flexible barrier passing through the first slit.

13. The infant safety barrier as in claim 12, wherein a second slit is formed in the second stanchion with the flexible barrier passing through the second slit.

14. The infant safety barrier as in claim 13, wherein a mounting rib is provided along the second end of the flexible barrier, the mounting rib being wider than the width of the second slit.

* * * * *